US006079527A

United States Patent [19]

Kuo

[11] Patent Number: 6,079,527

[45] Date of Patent: Jun. 27, 2000

[54] RETRACTABLE HANDLE FOR WHEELED LUGGAGE

[75] Inventor: Chung Hsien Kuo, Taipei Hsien, Taiwan

[73] Assignee: Chaw-Khong Technology Co., Ltd., Taipei, Taiwan

[21] Appl. No.: 09/164,936

[22] Filed: Oct. 1, 1998

[51] Int. Cl.[7] ..... A45C 13/00

[52] U.S. Cl. ..... 190/115; 190/18 A; 16/115; 280/37

[58] Field of Search ..... 190/18 A, 115; 16/115; 280/37

[56] References Cited

U.S. PATENT DOCUMENTS

| | | | |
|---|---|---|---|
| 5,459,908 | 10/1995 | Chen | 190/115 X |
| 5,500,981 | 3/1996 | Ho | 190/115 X |
| 5,630,521 | 5/1997 | Waddell et al. | 190/115 X |
| 5,653,319 | 8/1997 | Wang | 190/115 |
| 5,689,854 | 11/1997 | Wang | 16/115 |
| 5,690,196 | 11/1997 | Wang | 190/115 |
| 5,692,266 | 12/1997 | Tsai | 190/115 X |
| 5,706,921 | 1/1998 | Wang | 190/115 |
| 5,727,898 | 3/1998 | Lu | 16/115 X |
| 5,729,866 | 3/1998 | Chg | 190/115 X |

*Primary Examiner*—Stephen P. Garbe
*Assistant Examiner*—Tri M. Mai
*Attorney, Agent, or Firm*—Tung & Associates

[57] ABSTRACT

A retractable handle system for wheeled luggage comprises a handle grip assembly connected to sliding tubes adapted to slidingly move within support tubes rigidly affixed to a support. There are provided two locking assemblies for locking the system in its initial, retracted position. To place the system in an operational position, a push button on the handle grip assembly is depressed thus unlocking the sliding tubes. The sliding tubes can be pulled up and moved out of the supporting tubes. Then, the sliding tubes can be rotated at up to 45° and locked in that rotated position.

13 Claims, 13 Drawing Sheets

RETRACTABLE HANDLE FOR WHEELED LUGGAGE

BACKGROUND OF THE INVENTION

1. Field of the Invention

The present invention relates generally to wheeled luggage, more particularly a handle for wheeled luggage. Specifically, the present invention relates to a retractable handle for wheeled luggage, and still more specifically, a pull retractable handle having two parallel arms which can both be controllably positioned with readiness in operation.

2. Description of the Related Art

Wheeled luggage has been popularly used in recent years by travelers in various forms of transportation. When designing a wheeled luggage, a number of important criteria must be satisfied. For instance, the luggage should be rigidly constructed for surviving rough handling when pulled in the streets, in and out of buildings with ascending or descending steps, and in and out of various forms of carriers such as airplanes or motor vehicles. The wheeled luggage must also have adequate wheel means such that the luggage can be pulled along on a pavement with relative ease.

Also, the wheeled luggage should have a convenient pull-handle system that can be easily stowed away when not in use and extended when needed. Most types of luggage of large or medium size sold in markets are equipped with a pull handle of various types so as to facilitate carrying of the same in journey.

One difficulty frequently encountered in using wheeled luggage is the lack of a reliable pull-handle system that can be used for locking and unlocking a handle so that the handle can be extended for use, fixed in an operational position at a predetermined angle, and then unlocked and retracted for storage.

Efforts have been made by others to remedy the problems. For instance, in U.S. Pat. No. 5,526,908, a retractable handle assembly which can be easily expanded and folded without exerting a large force thereon. The retractable handle assembly includes a hollow bracket mounted on a top plate of one of the half bodies thereof, a pair of lug portions each formed on one of the distal end portions of the bracket and each having a first bore laterally defined therein, a pair of outer tubes each securely mounted between the lug portion and a bottom plate of the half body and each having a second bore laterally defined therein for aligning with the first bore, the pair of inner tubes each is slidably mounted in one of the outer tubes and each having a third bore laterally defined therein for aligning with the second bore, a substantially U-shaped handle portion mounted on the bracket and having two free end portions each engaged with the upper end of a corresponding one of the inner tubes, a pressing member movably mounted in a hollow bracket and including a knob extending through an opening of the hollow bracket, a biasing member mounted on an underside of the present member and including a pair of stubs each respectively extending through the first bore of associated lug portion, the second bore of associated outer tube and the third bore of associated inner tube.

In another issued U.S. Pat. No. 5,499,426, a handle device is disclosed which includes a pair of storage tubes adapted to be mounted on a rear face of a wheeled suitcase, a seat frame, a handle member and a locking mechanism. The locking mechanism is provided in the receiving space of the seat frame and includes two projecting members, a biasing unit between the projecting members for biasing the projection members toward the storage tubes and for locking the handle member relative to the storage tubes when the two engaging holes are in alignment, and a retracting unit for retracting the projecting members to release the handle member relative to the storage tubes. U.S. Pat. No. 5,431,428 discloses a carrying case assembly that is equipped with a collapsible handle assembly disposed within the case, the handle assembly includes a push button which allows the handle to collapse within the case. The handle assembly further includes a lock means for holding the first handle portion in an extended position relative to the second handle portion, the handle lock means includes a selectably releasable handle-locking protrusions on one of the first and second handle portions, movable in opposing directions toward and away from the other of the first and second handle portions into and out of engagement therewith. In still another issued patent, U.S. Pat. No. 5,502,876 a pull handle for a trunk is disclosed which includes a pair of driving rods each having a wedge member disposed at the bottom end thereof and is in abutment with a spring biased locking seat having an oblique cam surface. Each driving rod is housed in a hollow tube and the locking seat is in selective engagement with one of a plurality of spaced retaining slots disposed on a movable sleeve which accommodates each hollow tube.

SUMMARY OF THE INVENTION

Therefore, the main object of the present invention is to provide a retractable handle system for wheeled luggage which keeping all the advantages of the prior art system would be free, at the same time, of their drawbacks.

Another object of the present invention is to provide a retractable handle system for wheeled luggage which can be used for locking and unlocking a handle so that the handle can be extended for use, fixed in an operational position at a predetermined angle, and then unlocked and retracted for storage.

To achieve the above and other objects, there is provided a retractable handle system for wheeled luggage, comprising a handle grip assembly adapted to be acted upon by a user, a bezel assembly, a pair of sliding tubes of a generally rectangle cross-section, a pair of support tubes of a generally rectangle cross-section, a pair of locking assemblies accommodated in lower parts of the sliding tubes, and a support. The sliding tubes have upper ends and lower ends, are attached with the upper ends to the handle grip assembly and pass from the handle grip assembly down through the bezel assembly. The support tubes have upper ends and lower ends, are attached with their upper ends to the bezel assembly and go downward. The support tubes are adapted to receive the sliding tubes therein. The pair of locking assemblies are attached to the lower ends of the sliding tubes. The support is adapted to receive and secure the lower ends of the support tubes. The bezel assembly comprises rotating means, that allows the sliding tubes and the locking assemblies when pulled up to be rotated into a predetermined angle position and locked therein.

The retractable handle system according to the present invention also comprises control cables connecting the handle grip assembly with the locking assemblies, such that the locking assemblies can be controlled from the handle grip assembly.

The bezel assembly comprises a bezel base, and the rotating means includes a pair of rollers, whereas the bezel base is provided with two identical side pockets to accommodate the rollers, and the rollers are provided with through holes adapted to receive the sliding tubes.

The bezel assembly also comprises hollow sleeves that project downwardly from a bottom of the bezel base and are adapted to receive top portions of the support tubes.

Each of the rollers is provided with roller pins on both sides of the roller, and each of the side pockets is provided with pocket slots on both its sides to receive the roller pins.

The bezel base is provided with two pocket recesses protruding outwardly from lower portions of the side pockets, and a gap is provided between a bottom surface of the rollers and an inner bottom surface of the side pockets, to thereby allow pivot the rollers into the pocket recesses at a predetermined angle.

The locking assemblies comprises a static element, a movable element, and a locking pin. The static element accommodates a lower end of the sliding tube, the movable element has a spring-loaded fit onto the static element, and locking pin is adapted to move from an unlocked position to a locked position, the movable element operationally controlling the motion of the locking pin.

In another aspect of the present invention, there is provided a wheeled luggage with a retractable handle system. The luggage comprises a suitcase-like body with a top, bottom, front, back, and two side sides, the body being equipped with two fixed wheels and at least one caster-like wheel. The fixed wheels and the at least one caster-like wheel are arranged substantially on the bottom side of the luggage body. The retractable handle system is accommodated within a compartment attached preferably to the back side. The retractable handle system comprises a handle grip assembly adapted to be acted upon by a user, a bezel assembly, a pair of sliding tubes that have upper ends and lower ends, a pair of support tubes with upper ends and lower ends, a locking means accommodated in lower parts of the sliding tubes, attached to the lower ends of the sliding tubes, and adapted to lock the system in a preselected position; and a support adapted to receive the lower ends of the support tubes and secure same therein. The sliding tubes are attached with the upper ends to the handle grip assembly and passing from this handle grip assembly down through the bezel assembly. The support tubes have upper ends and lower ends, the tubes are attached with their upper ends to the bezel assembly from which these support tubes go downward, and the support tubes are adapted to receive the sliding tubes therein. The bezel assembly comprises rotating means, whereby the sliding tubes and the locking means when pulled up can be rotated into a predetermined angle position and locked in that position.

BRIEF DESCRIPTION OF THE DRAWINGS

These and other objects, features and advantages of the present invention will be more easily understood from the ensuing specification when discussed in conjunction with the accompanying drawings in which.

DETAILED DESCRIPTION OF THE PREFERRED EMBODIMENT

The present invention discloses a retractable pull-handle system that can be used on any wheeled articles that can be pulled but is particularly suitable for use on a wheeled luggage for locking and unlocking of a retractable pull-handle.

Figure 1:
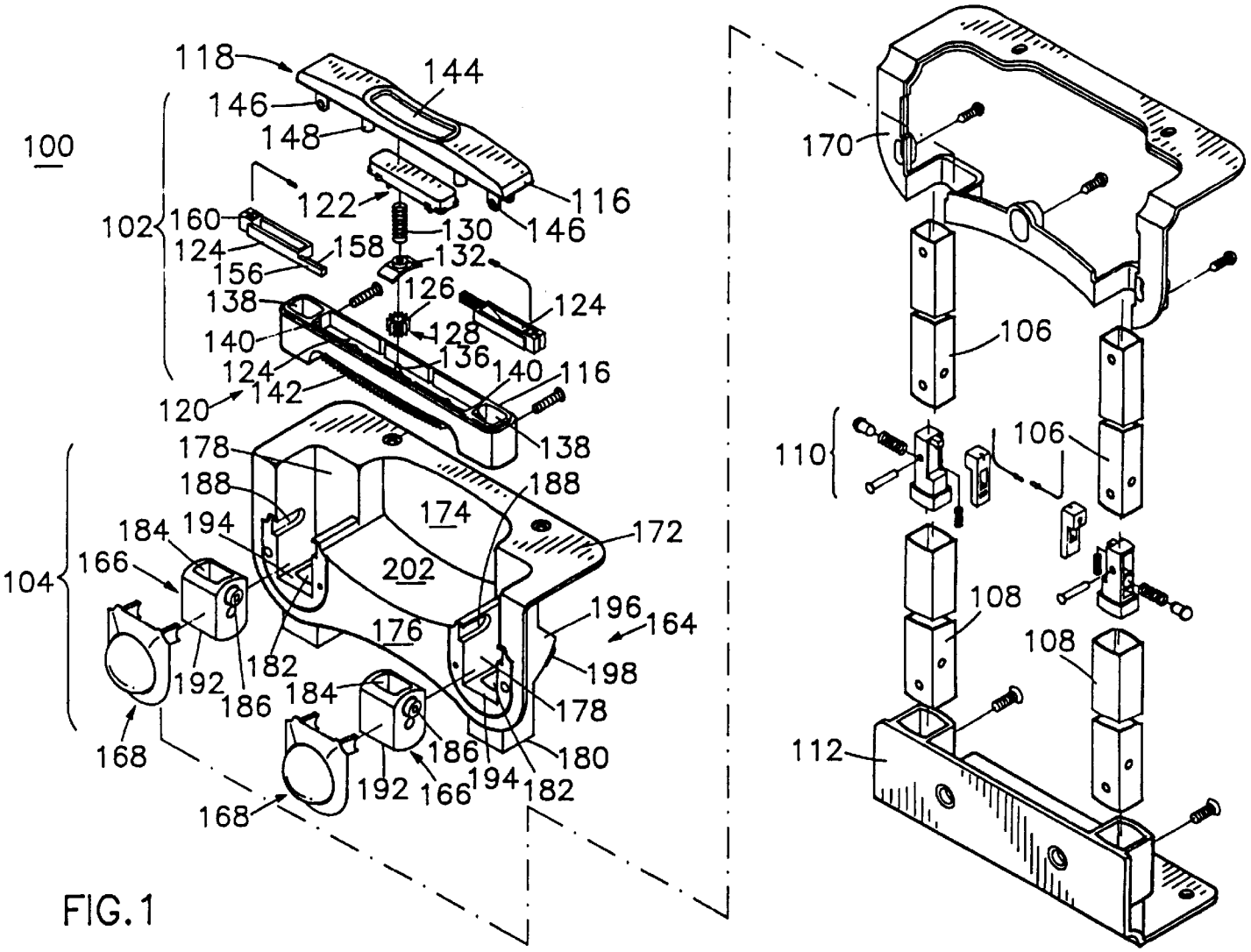
FIG. 1 is an exploded perspective view of the retractable handle system according to the present invention.
Figure 2:
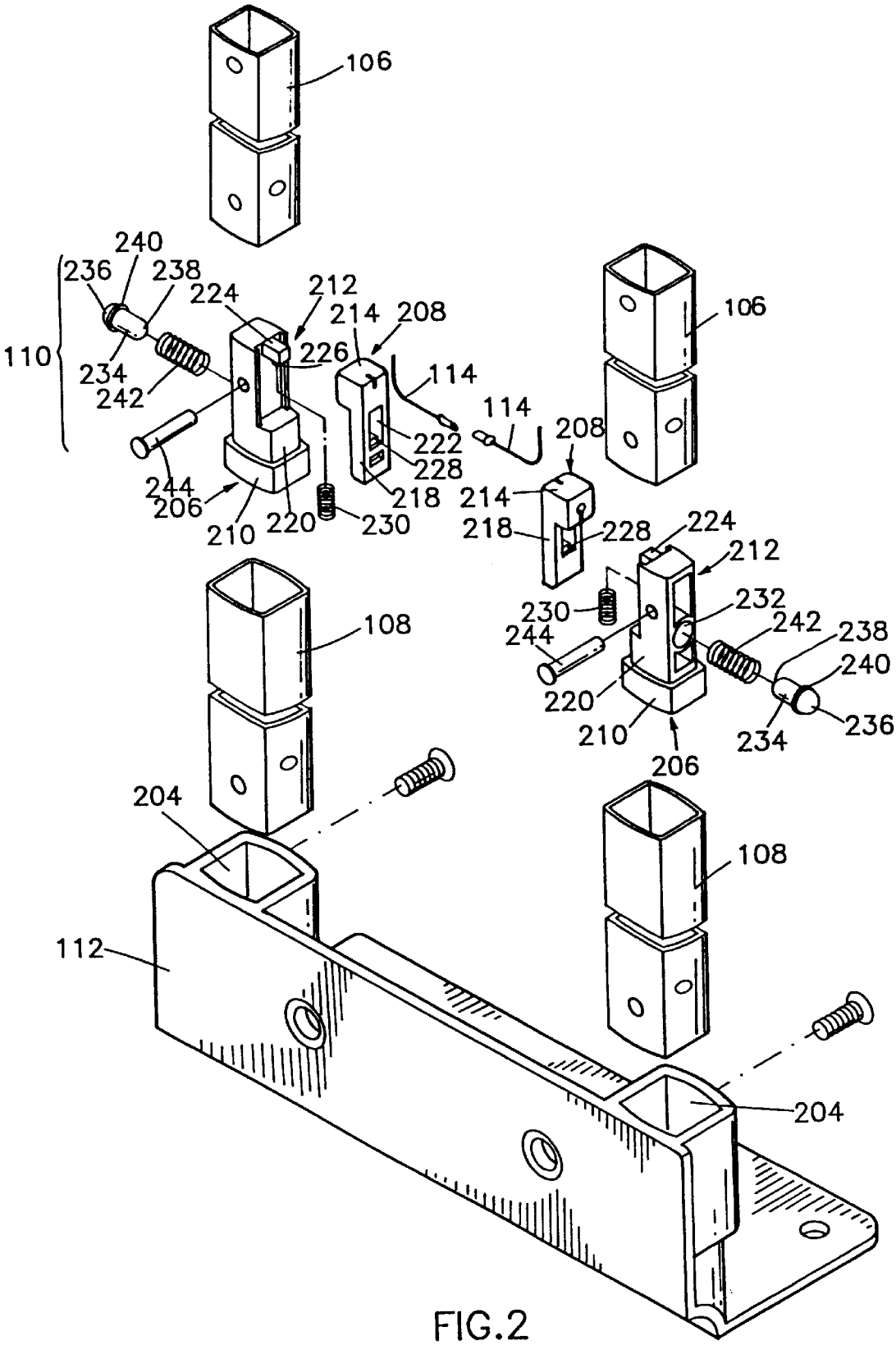
FIG. 2 presents an enlarged lower portion of the exploded perspective view of the retractable handle system according to the present invention shown in FIG. 1.
Figure 3:
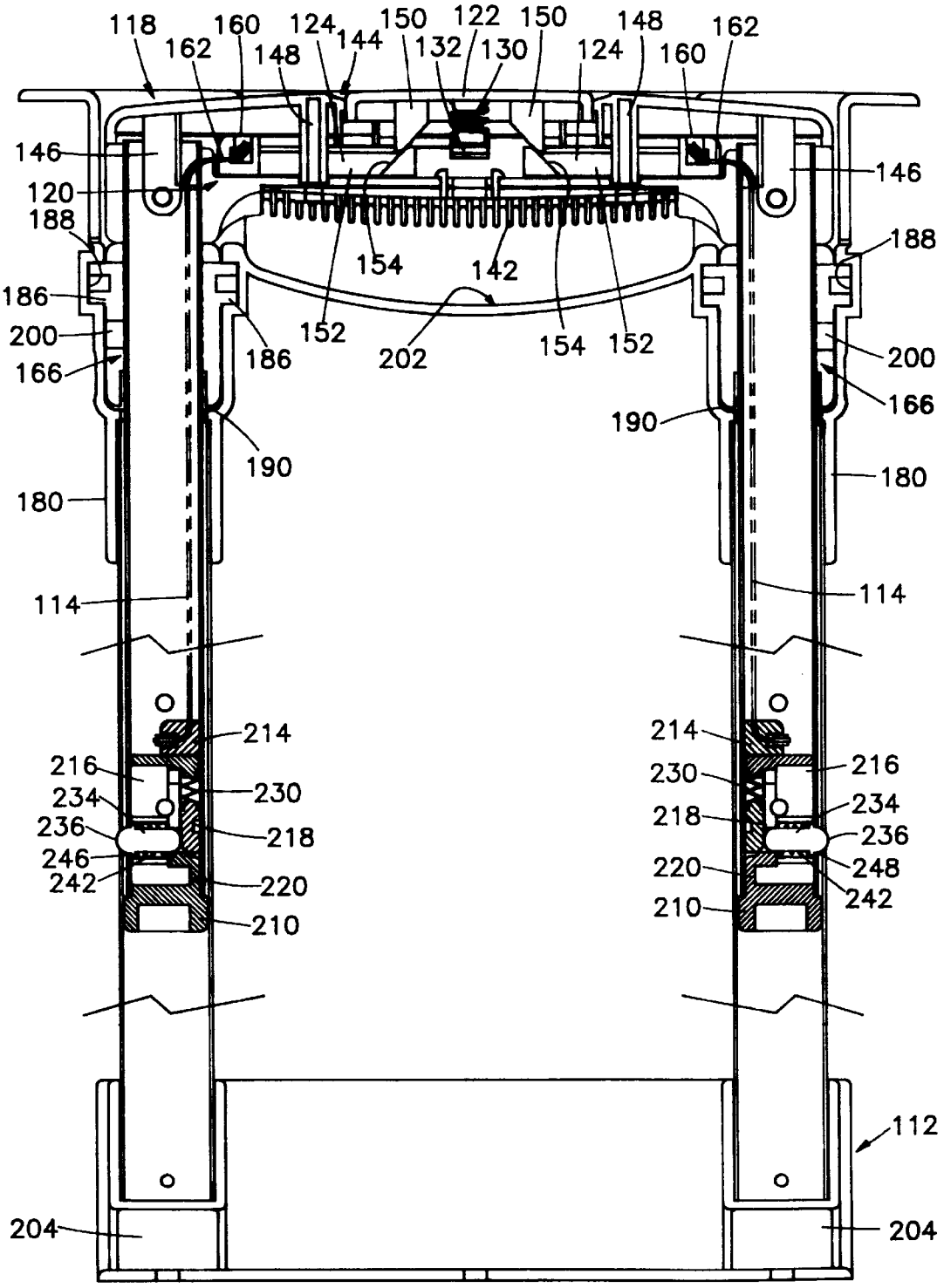
FIGS. 3–7 illustrate successive phases of putting the retractable handle system according to the present invention into an operational condition, with locking assemblies shown in cross-sectional view, the cross-section being made in a plane uniting the whole system.
Figure 4:
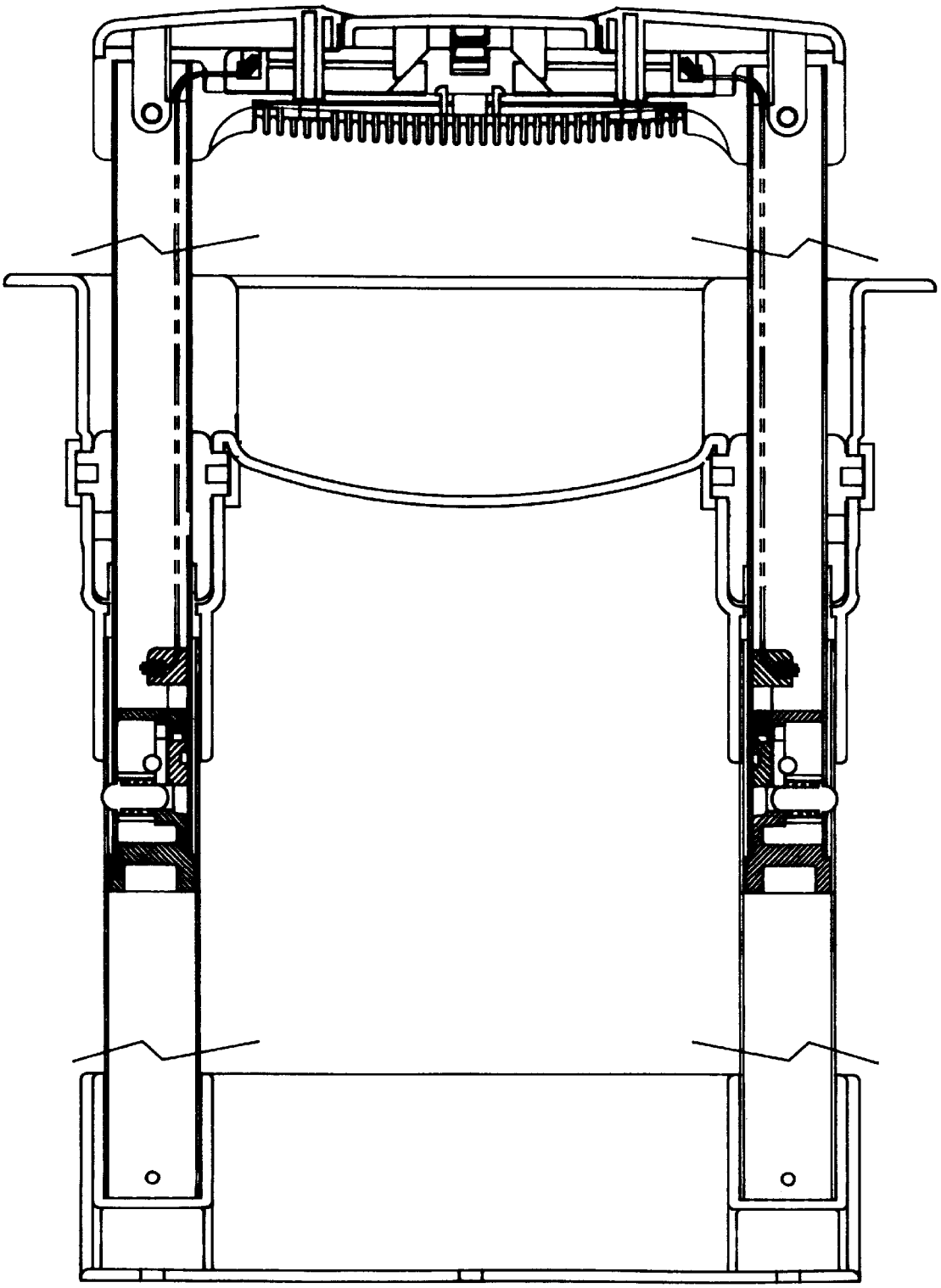

Attention is invited now to FIGS. 1–3. A retractable pull-handle system 100 according to the present invention generally comprises a handle grip assembly 102, a bezel assembly 104, a pair of sliding tubes 106 of a generally rectangle cross-section, with two opposite sides of possibly arcuate profile; the sliding tubes 106 have upper ends and lower ends (if the system 100 is viewed in an upright position), they are attached with the upper ends to the handle grip assembly 102 and pass from the handle grip assembly 102 down through the bezel assembly 104; a pair of support tubes 108 of a generally rectangle cross-section, with two opposite sides of possibly arcuate profile; the support tubes 108 have upper ends and lower ends, they are attached with the upper ends to the bezel assembly 104 from which they go downward, and the support tubes 108 are adapted to receive the sliding tubes 106 therein; a pair of locking assemblies 110 accommodated in lower parts of the sliding tubes 106 and attached to the lower ends thereof, and support 112 adapted to receive and secure the lower ends of the support tubes 108 therein.

A pair of flexible control cables 114 (FIG. 3) pass from the handle grip assembly 102 through the sliding tubes 106 to the locking assemblies 10. The flexible control cables 114 can be any flexible control cable, and, for example and most suitably, can be cables braided by a number of thin steel wires.

The handle grip assembly 102 comprises a housing 116 having an upper portion 118 to and a lower portion 120, a push button 122, a pair of sliding blocks 124, a gear wheel 126 with a center aperture 128, a spring 130, and a spring mounting plate 132.

Inside the lower portion 120 of the housing 116, a cavity 134 is provided with a shaft 136 affixed at the center of the cavity 134. Provided also in the lower portion 120, bordering on the cavity 134, and situated at the ends of the lower portion 120 are two identical through openings 138 separated from cavity 134 by two partitions 140. The openings 138 are intended for receiving the sliding tubes 106. A comb plate 142 is attached to the lower portion 120 from the bottom side thereof.

The upper portion 118 of the housing 116 is provided with an opening 144 in its central part. Also in the upper portion 118, there are provided two pairs of tongues 146 with ears 148 for securing the sliding tubes 106 thereto, and two pairs of pins 148 passing through periphery of the cavity 134 down to the comb plate 142. Securing the comb plate 142 to the pins 148 keeps all the components of the handle grip assembly 102 together.

The push button 122 is installed in the opening 144 situated at the center part of the housing 116 upper portion 118, symmetrically relative to its ends that allows it to freely move in downward/upward directions. There are two wedges 150 projecting downwardly from the bottom of the push button 122, symmetrically relative the center of the push button 122 and the upper portion 118.

The pair of sliding blocks 124 is installed inside the cavity 134 on each side of the shaft 136 and symmetrically relative to the shaft 136. In their static position, the sliding blocks 124 are urged by the weight of the control cable to engage an extreme external position in the cavity 134 and lean against the partitions 140 that thus leaves them the possibility to move within the cavity 134 in a longitudinal direction toward the shaft 136 only.

Each of the sliding blocks 124 is made with a recess 152 with an inclined surface 154. The inclined surfaces of the wedges 150 and the inclined surfaces 154 are adapted to cooperate with each other in respective pairs and accordingly match each other. Each of the sliding blocks 124 has a leg portion 156 extended toward the other sliding block 124 and provided with a gear face 158 facing the shaft 136 when installed in the cavity 134. The gear wheel 126 is installed onto the shaft 136 through the center aperture 128 such that it may rotate on the shaft 136. The gear teeth pattern on the gear wheel 126 matches the gear teeth pattern on the gear face 158 of the leg portion 156 of the sliding block 124. Thus, the gear face 158 and the gear wheel 126 operate together in a rack-and-pinion fashion. The rack-and-pinion operation between the gear wheel 126 and the gear faces 158 of the sliding blocks 124 therefore stabilizes the inward motion of the sliding blocks 124 and the pulling action of the cables 114 when the push button 122 is downwardly pressed and the inclined surfaces of wedges 150 cooperate with the inclined surfaces 154 in the sliding blocks 124. The engagement between the gear wheel 126 and the gear faces 158 also helps to eliminate possible problems that may be caused by a non-uniform application of forces on top of the push button 122.

In the opposite ends of the sliding blocks 124, sockets 160 are provided for retaining upper ends of the control cables 114 coming through slots 162.

The bezel assembly 104 comprises a bezel base 164, a pair of rollers 166, a pair of bumpers 168, and a bezel cover 170. The bezel base 164 has a base top surface 172, and there is provided a shaped recess 174 in the bezel base 164 generally open from the top thereof. The shaped recess 174 has two identical side pockets 178 of a generally rectangle, preferably square cross-section, to accommodate the rollers 166. The two side pockets 178 pass from the base top surface 172 down and do not reach the bottom of the bezel base 164 only to leave the thickness practicably sufficient for structural strength of the bezel base 164. There is a thickening 176 in the central portion of the shaped recess 174.

Hollow sleeves 180 project downwardly from the bottom of the bezel base 164. They are adapted to receive top portions of the support tubes 108 in their holes 182.

The rollers 166 are of a generally rectangle, preferably square cross-section, with top and bottom surfaces having possibly arcuate profile. The rollers 166 are provided with through holes 184 adapted to receive the sliding tubes 106.

There are pins 186 on both sides of each roller 166, and there are pocket slots 188 on both sides of each pocket 178, the pocket slots 188 being adapted to receive the pins 186. When the bezel assembly 104 is assembled, the rollers 166 hang on the pins 186 in the slots 188 and leave a small gap 190 between their bottom surface 192 and an inner bottom surface 194 of the pockets 178. Due to that gap 190, the rollers 166 can pivot—generally up to 45°. To make the pivoting feasible, the bezel base 164 is provided with two pocket recesses 196 protruding outwardly from lower portions of the pockets 178 and externally looking like lugs 198. There are also through holes 200 in sides of the rollers 166 which will be discussed below in more details.

The thickening 176 of the bezel base 164 has a top surface 202 lying below the base top surface 172. The distance between the thickening top surface 202 and the comb plate 142 is selected wide enough to allow a convenient grip by a user.

When assembled, the bezel assembly 104 has the bezel cover 170 covering the bezel base top surface 172 and the thickening 176. The bumpers 168 are to be inserted into the slots 178 and cover the rollers 166 limiting their movement.

Two support sockets 204 are provided in the support 112 and adapted to receive and secure the support tubes 108.

The locking assemblies 110 are structurally symmetric relative an imaginary symmetry axis passing between them. Each of the assemblies 110 comprises a static element 206 and a movable element 208 spring-loadedly fit onto the static element 206. The static element 206 comprises a pedestal part 210 and a standing part 212. The movable element 208 and the standing part 212 have an upright and up-side-down G-like shapes, respectively. Therefore, both the static element 206 and the movable element 208 have horizontal and vertical portions. When put together, the movable element 208 and the standing part face each other and are compatible in such a way that a horizontal portion 214 of the movable element 208 rests on a top of a vertical portion 216 of the standing part 212, while a vertical portion 218 of the movable element 208 stands on a horizontal portion 220 of the standing part 212.

There is an opening 222 in the vertical portion 218 of the movable element 208, and there is a projection 224 centrally located at the vertical portion 216 of the standing part 212, the projection 224 being flush with the top of the portion 220. The projection 224 faces the opening 222 and adapted to be received therein. The projection 224 is provided with an upper pin 226 and there is a lower pin 228 set in the opening 222 opposite the upper pin 226. It is a vertical spring 230 secured between the pins 226 and 228 that urges the horizontal portion 214 of the movable element 208 to cling to the top of the vertical portion 216 of the standing part 212, thus providing the fit setting of the movable element 208 onto static element 206.

A through hole 232 is made in the standing part 212, and there is provided a locking pin 234 placed in the through hole 232. The locking pin 234 has a front end 236, a rear end 238, and a flange 240. A locking spring 242 is put on the locking pin 234.

Each of the locking assemblies 110 is secured within a lower part of the respective sliding tube 106 by means of a fixing pin 244, a bottom of the sliding tube 106 standing on the pedestal part 210 of the static element 206, so the sliding tubes 106 are capable of moving within the support tubes 108 together with the locking assemblies 110 attached to them. The support tubes are provided with support tube locking holes 246, whereas the sliding tubes 106 are provided with sliding tube locking holes 248. The locking holes 246 and 248 are made at such a level that when the locking assemblies 110 are installed within the sliding tubes 106 in the retracted position of the handle system 100, the locking pins 234 are urged by the vertical portions 218 of the movable elements 208 to move outwardly, compressing the locking springs 242, the front ends 236 of the locking pins 234 passing through the locking holes 246 and 248 thus effectively preventing the sliding tubes 106 from being pulled up. The flanges 240 whose diameter is selected to be larger than a diameter of the holes 246 and 248 prevent the locking pins 234 from falling out of the tubes and also serve stops for locking springs 242.

Lower ends of the control cables 114 are embedded in the horizontal portions 214 of the movable elements 208.

Now, attention is invited to FIGS. 3–11 to illustrate in operation the retractable handle for wheeled luggage according to the present invention.

The initial, static position of the system is illustrated by FIG. 3. When the user presses the push button 122 downwardly, compressing the spring 130 (FIG. 4), the inclined surfaces of the wedges 150 engage the inclined surfaces 154 in the recesses 152 of the sliding blocks 124 such that a vertical motion caused by the applied downward force is converted into a horizontal motion of the two sliding blocks 124 toward the center of the housing 116. As discussed in the above, the inward motion of the sliding blocks 124 is facilitated and stabilized by the rack-and-pinion operation between the gear wheel 126 and the gear faces 158 of the sliding blocks 124. Problems that may be caused by a non-uniform application of forces on top of the push button 122 are eliminated by the engagement between the gear wheel 126 and the gear faces 158 as well.

The horizontal motion of the sliding blocks 124 causes the ends of control cables 114 retained in the sockets 160 of sliding blocks 124 to also move toward the center of the housing 116. This motion results in pulling up the movable elements 208 of the locking assemblies 110 at the other ends of the control cables 114. Therefore, the vertical portions 218 of the movable members 208 do not shore up the locking pins 234 any more and under the influence of locking springs 242 the locking pins are being pushed out of the support tube locking holes 246. By holding the handle grip assembly, the user can freely pull up the sliding tubes 106.

Figure 5:
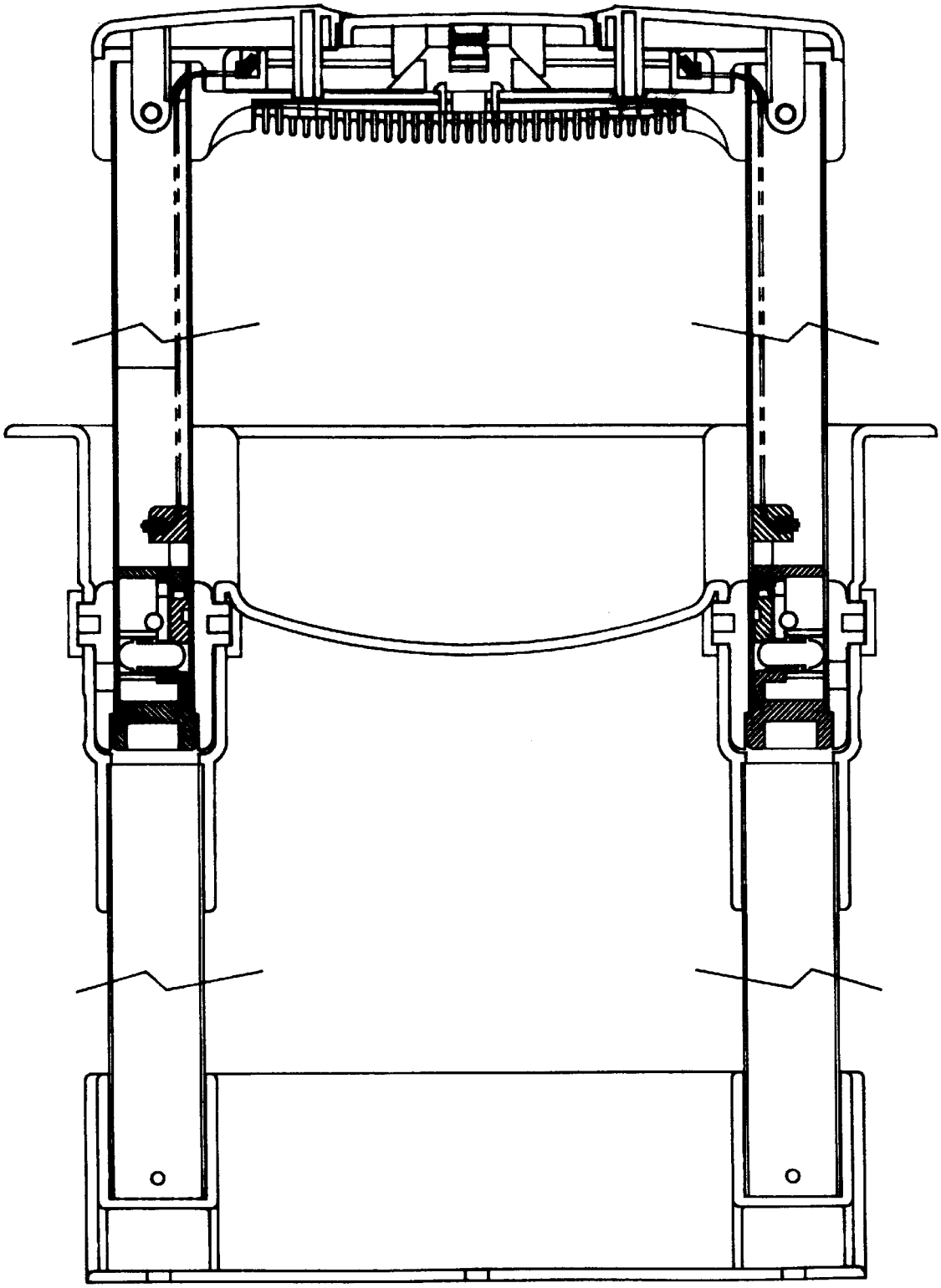
Figure 6:
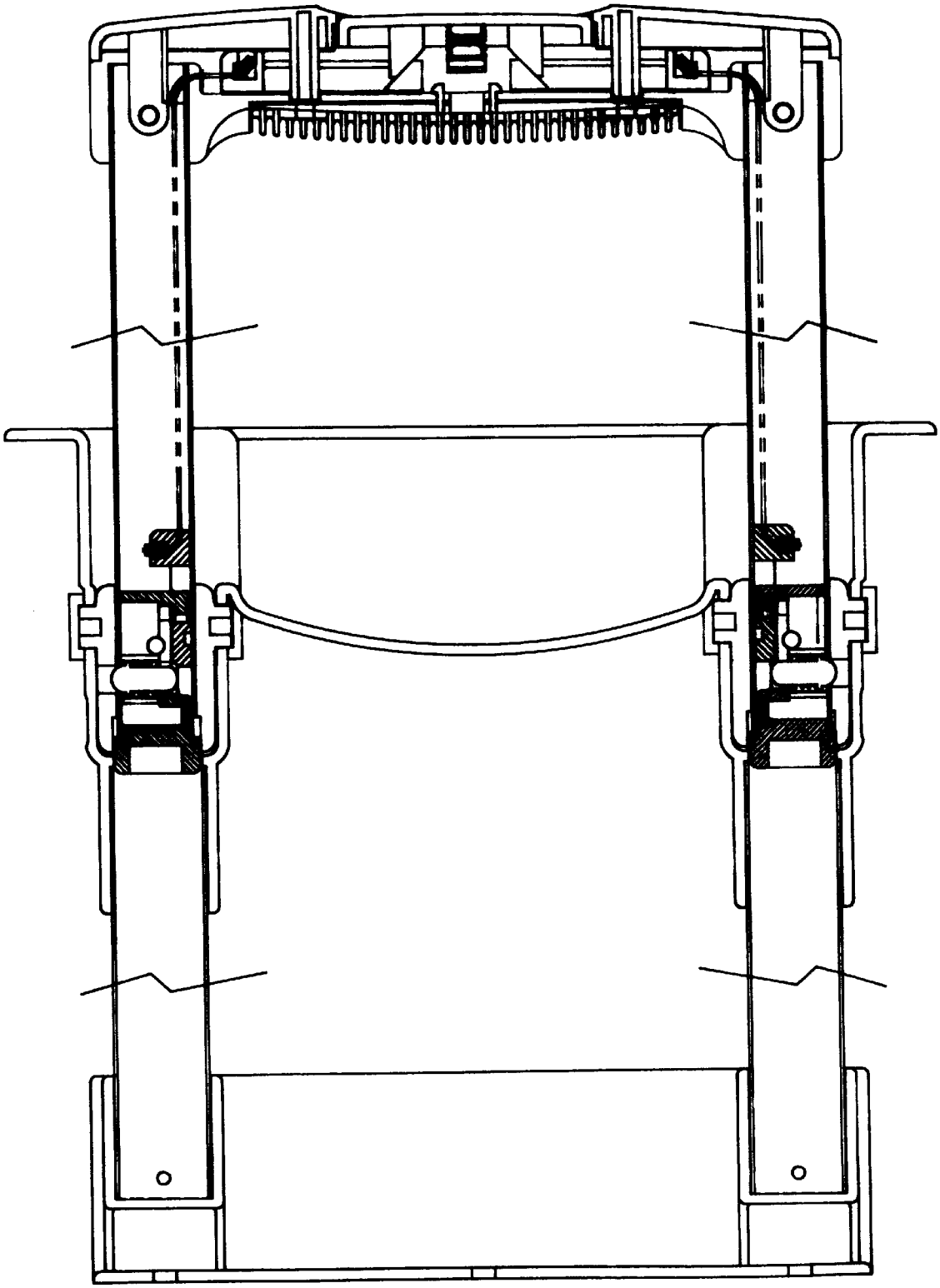
Figure 7:
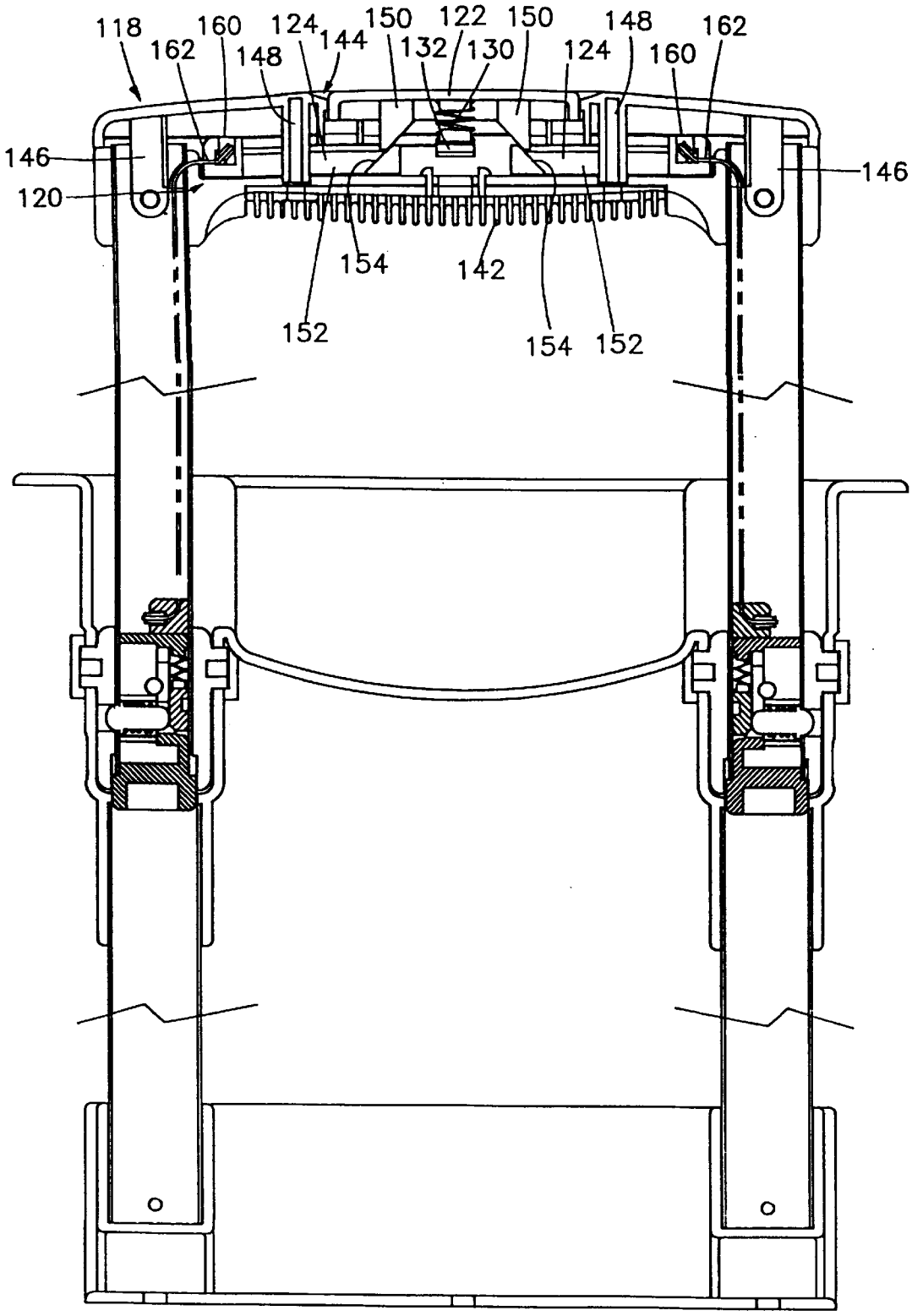
Figure 8:
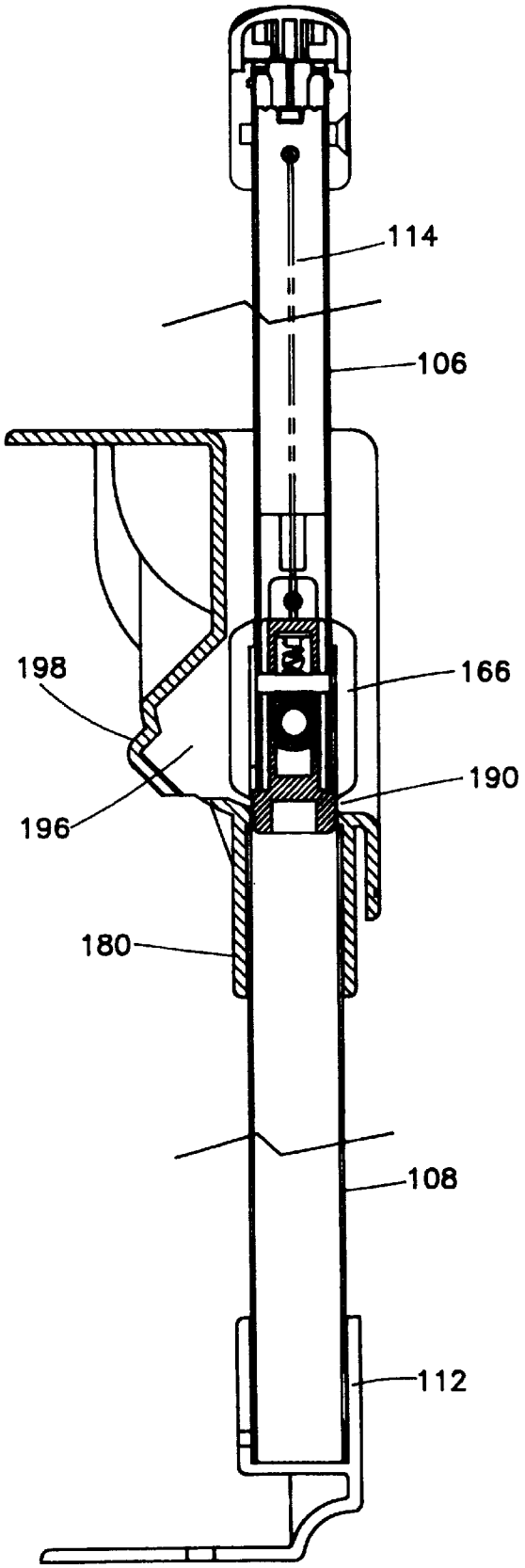
FIGS. 8–11 present successive phases of putting the retractable handle system according to the present invention into an operational condition, with locking assemblies shown in cross-sectional view, the cross-section being made in a plane normal to the cross-section plane of FIGS. 3–7.
Figure 9:
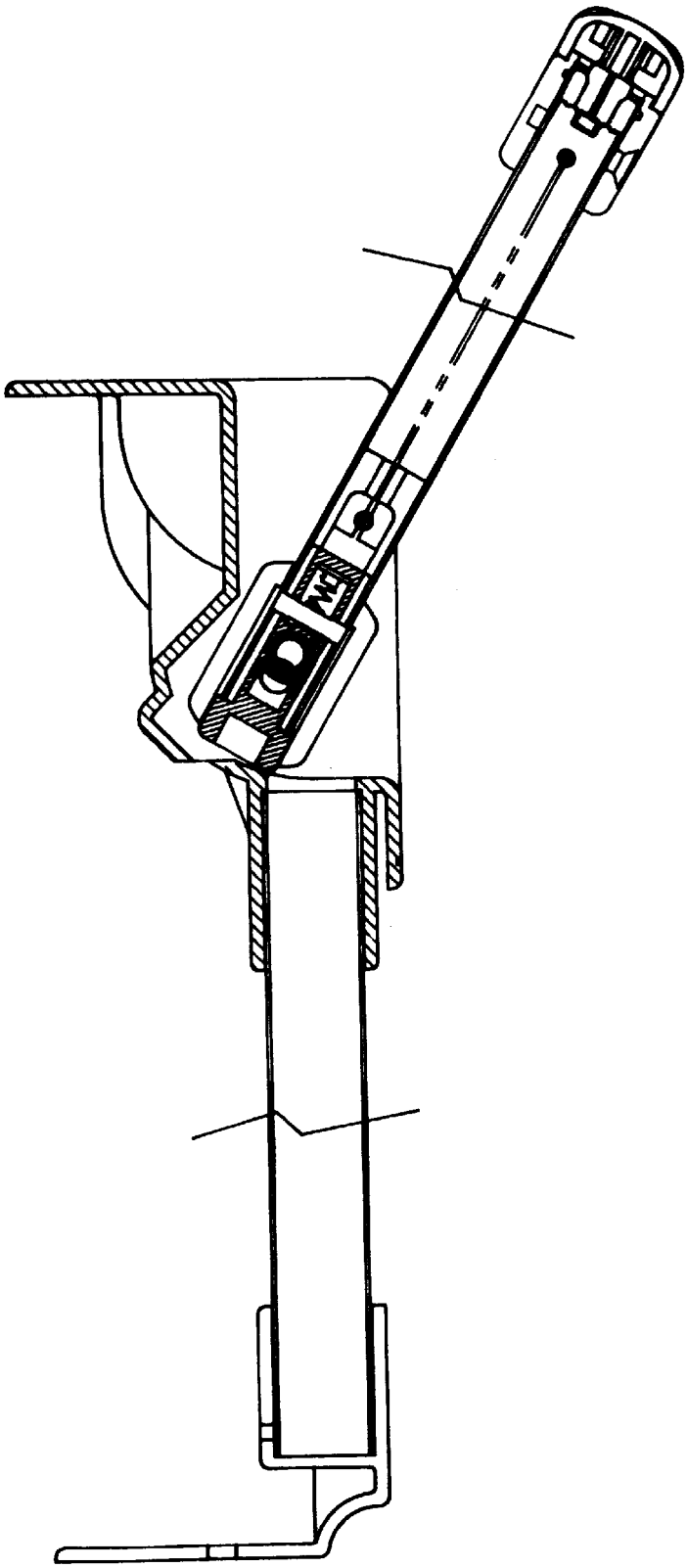
Figure 10:
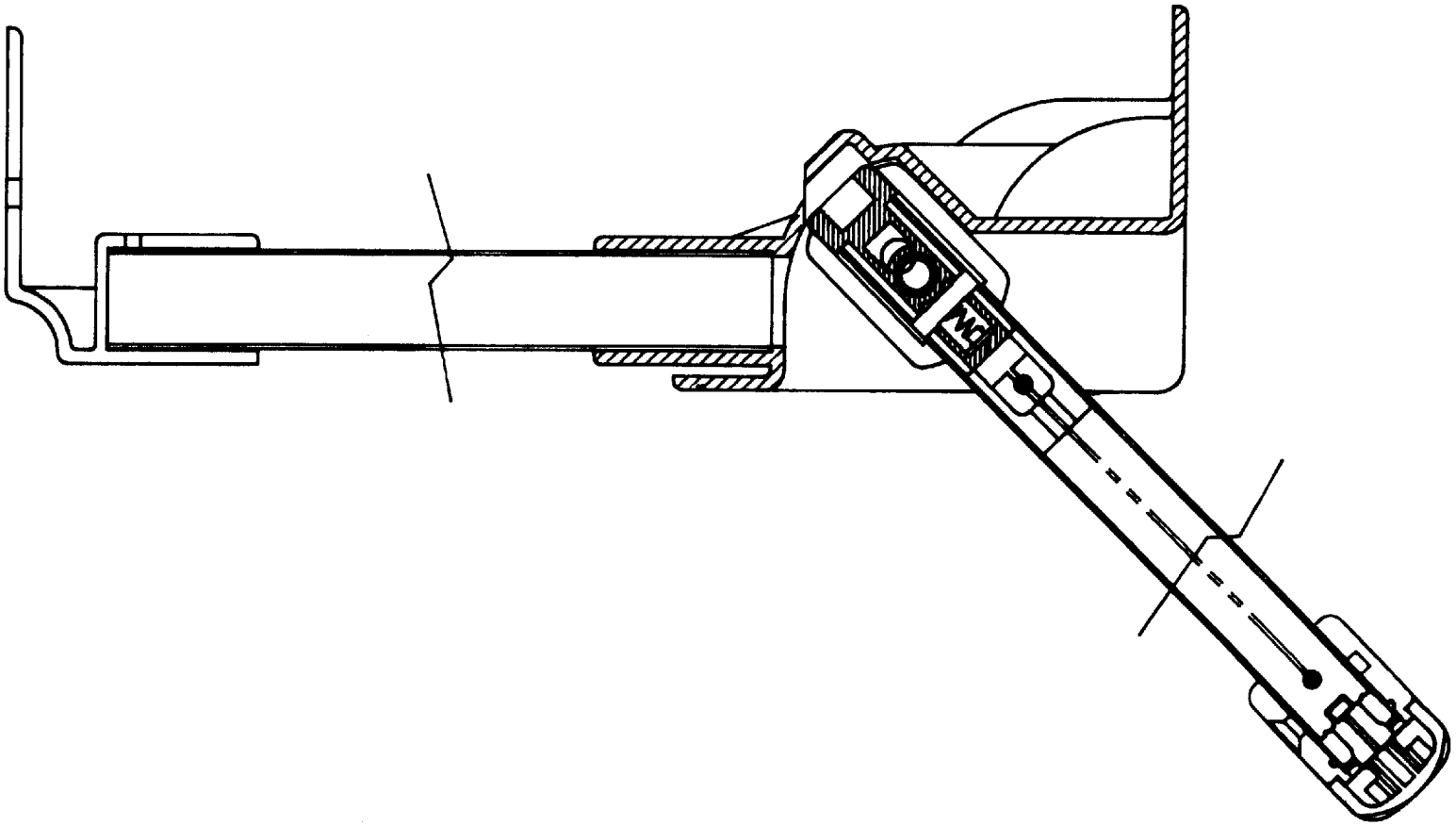
Figure 11:
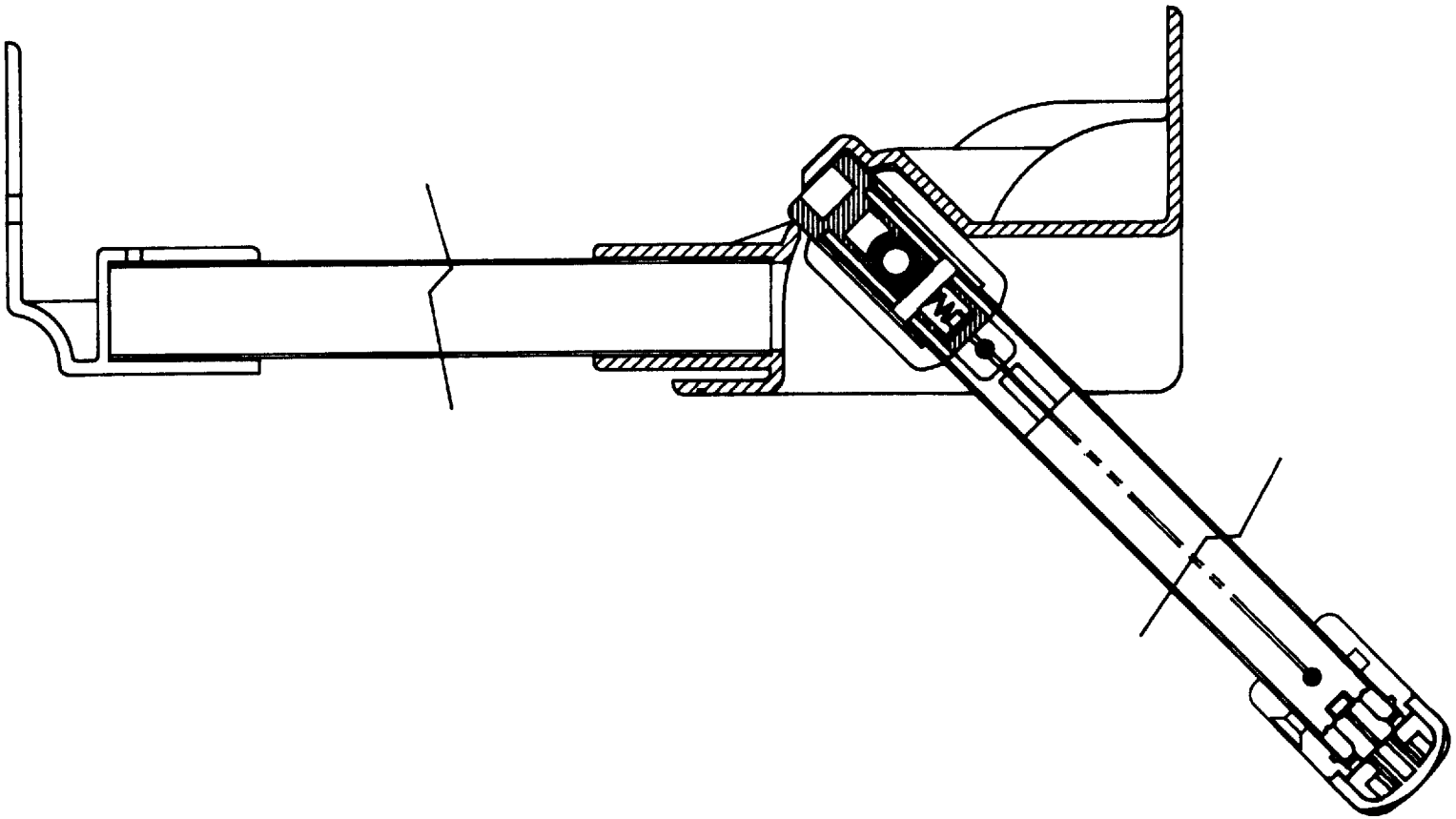

In their upward motion, the sliding tubes 106 together with locking assemblies 110 come to the position illustrated in FIGS. 5 and 8. The lower ends of the sliding tubes 106 went out of the support tubes 108, whereas the pedestal part 210 of the static element 206 of the locking assemblies 110 are still inside the support tubes 108. The front ends 236 of the locking pins 234 are in the through holes 200 made in the rollers 166. It is an intermediate locking position in which the system can be retained if the user so desires.

As best can be seen in FIGS. 8–11, in order to place the system according to the present invention into a tilted position, it is necessary to further pull up the sliding tubes 106 to have the locking assemblies pulled into the rollers 166. Again, the push button 122 must be depressed (FIG. 6), the locking springs 242 urge the locking pins 234 to move out of the holes 200, and then the handle grip assembly 102, together with the sliding tubes 106 and locking assemblies 110 are pulled up slightly more (generally about 5 mm). This additional vertical motion (if the position of the system 100 is upright) results in complete drawing the locking assemblies 110 into the rollers 166. Now, the handle assembly 102, the sliding tubes 106 and the locking assemblies 110 can be tilted up to 45° together with the rollers 166 (FIGS. 9 and 10), using the space formed by the pocket recesses 196. To lock the locking assemblies (and, accordingly, the sliding tubes 106 and the handle grip assembly 102), the push button 122 is released, and with all the above in view, the system 100 finds itself in the position shown in FIG. 11.

In order to bring the system back into the retracted position, the user should depress the push button 122, pull the system slightly up, tilt it back and push it down.

Figure 12:
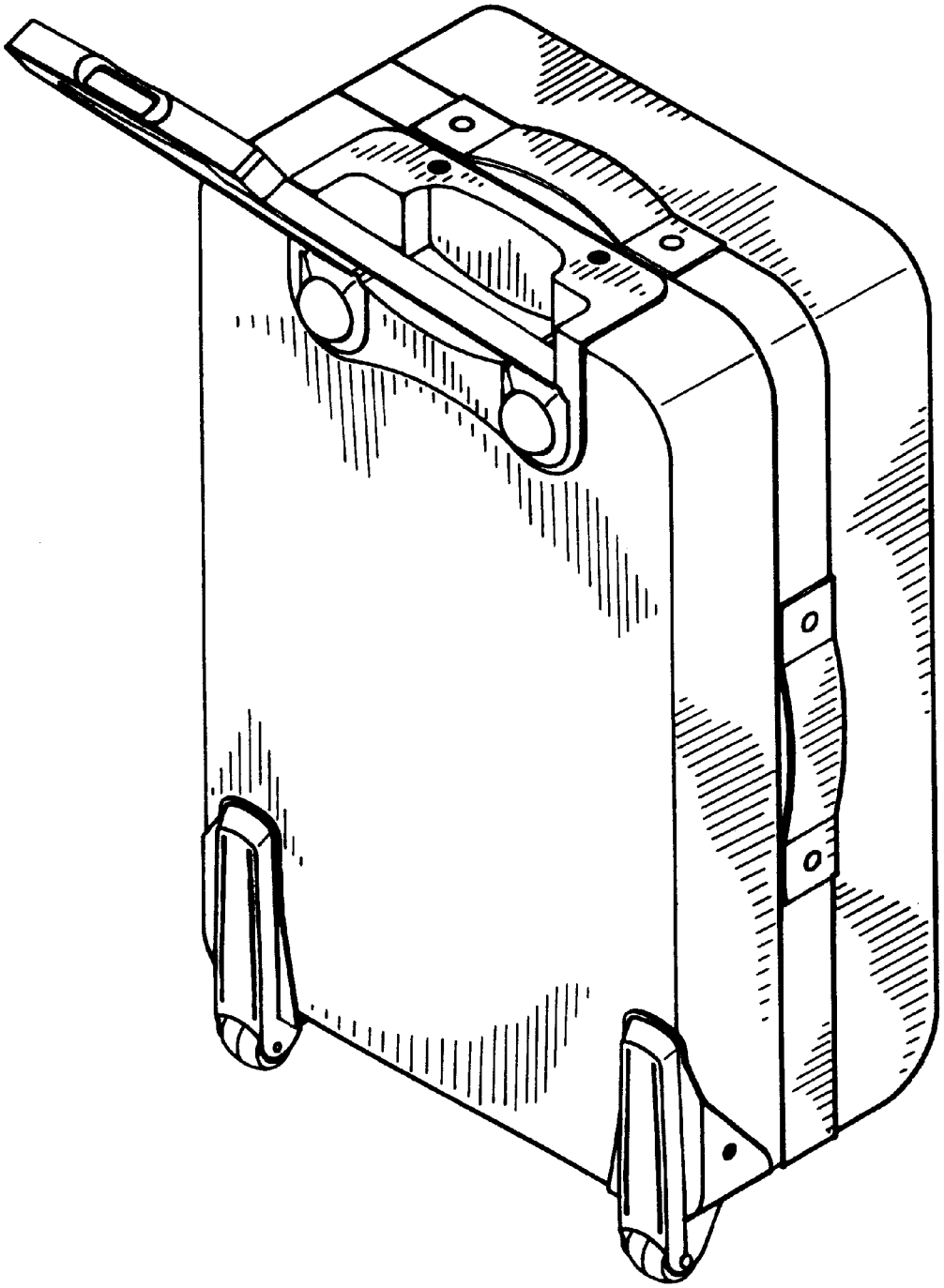
FIGS. 12 and 13 show wheeled luggage equipped with the retractable handle system of the present invention.
Figure 13:
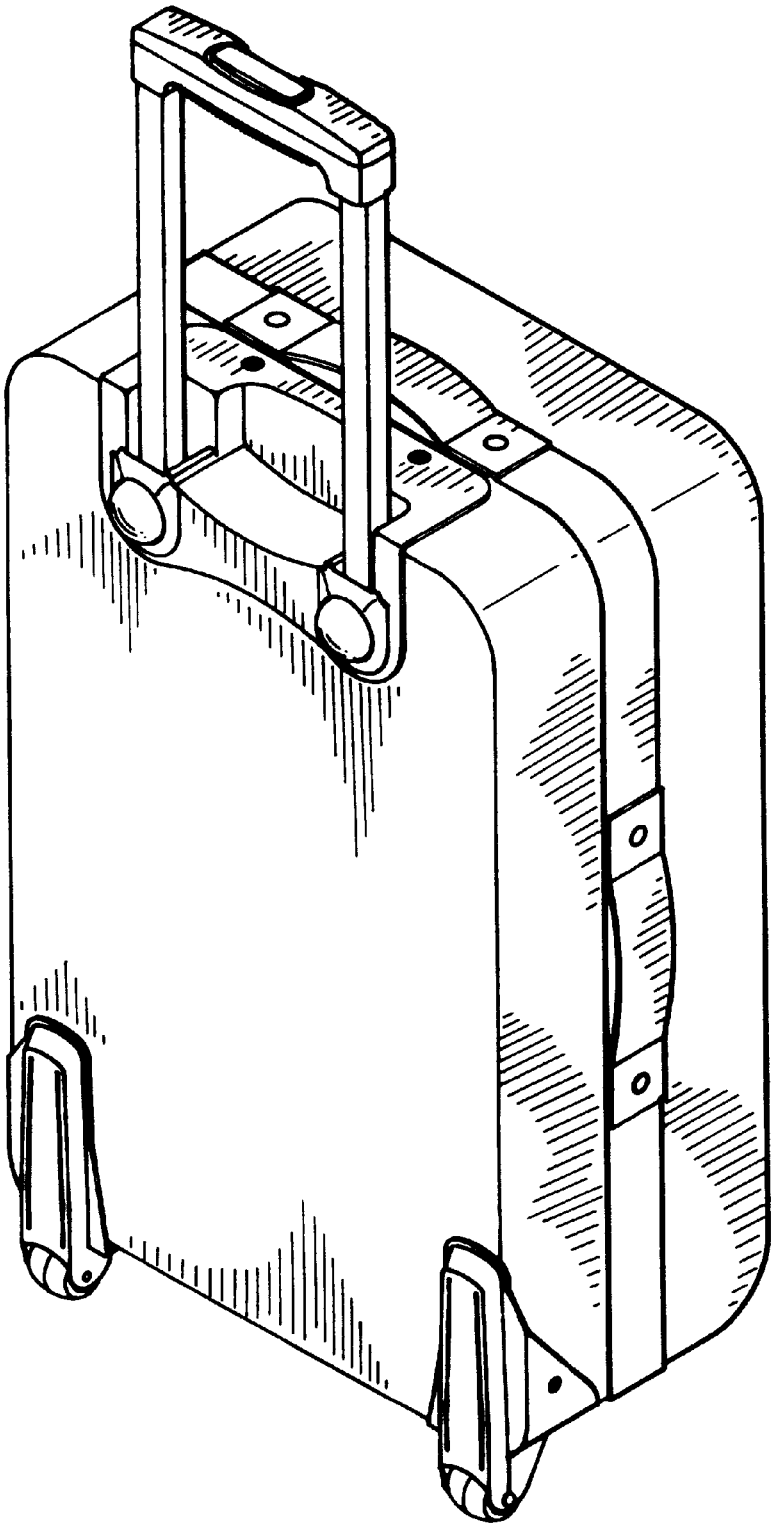

Various positions of the retractable handle system when installed in a wheeled luggage are shown in FIGS. 12 and 13.

FIG. 12 shows the system according to the present invention in the intermediate position where the retractable handle is pulled up but not tilted. FIG. 13 illustrates the situation where the handle system is not pulled up only but also tilted. Suitcases used for the illustration in FIGS. 12 and 13 are generally four-wheel suitcases with two fixed wheels and two caster-type wheels.

The drawings and the foregoing descriptions are not intended to represent the only forms of the invention in regard to the details of its construction and manners of operation. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated by and limited only to the extent of the following appended claims.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A retractable handle system for wheeled luggage, the system comprising:

a handle grip assembly adapted to be acted upon by a user, a bezel assembly, a pair of sliding tubes, said sliding tubes having upper ends and lower ends, the sliding tubes being attached with said upper ends to said handle grip assembly and passing from said handle grip assembly down through said bezel assembly, a pair of support tubes, said support tubes having upper ends and lower ends, said support tubes being attached with said support tube upper ends to said bezel assembly from which bezel assembly said support tubes go downward, said support tubes being adapted to receive said sliding tubes therein, locking means accommodated in lower parts of said sliding tubes, attached to said lower ends of said sliding tubes, and adapted to lock said sliding tubes to said support tubes, and a support adapted to receive and secure said lower ends of said support tubes therein, wherein said bezel assembly comprises a bezel base, and said rotating means includes a pair of rollers, said bezel base being provided with two pocket recesses protruding outwardly from lower portions of said side pockets and wherein there is provided a gap between a bottom surface of said rollers and an inner bottom surface of said side pockets to thereby allow pivot said rollers into said pocket recesses at a predetermined angle, said rollers being provided with through holes to receive said sliding tubes, whereby said sliding tubes and said locking means when pulled up can be rotated into a predetermined angle position and locked therein.

2. The retractable handle system as claimed in claim 1, further comprising control cables connecting said handle grip assembly with said locking means, whereby said locking means can be controlled from said handle grip assembly.

3. The retractable handle system as claimed in claim 1, wherein said locking means comprises a static element, a movable element, and a locking pin, said static element accommodating a lower end of said sliding tube, said movable element having a spring-loaded fit onto said static element, said locking pin being adapted to move from an unlocked position to a locked position, said movable element operationally controlling said motion of said locking pin.

4. The retractable handle system as claimed in claim 1, wherein said bezel assembly further comprises hollow sleeves projecting downwardly from a bottom of said bezel base and adapted to receive top portions of said support tubes.

5. The retractable handle system as claimed in claim 1, wherein said rollers are provided with roller pins on both sides of each of said rollers, and each of said side pockets is provided with pocket slots on both sides of said each pocket, said pocket slots being adapted to receive said roller pins.

6. The retractable handle system for wheeled luggage, the system comprising:

a handle grip assembly adapted to be acted upon by a user, a bezel assembly, a pair of sliding tubes, said sliding tubes having upper ends and lower ends, the sliding tubes being attached with said upper ends to said handle grip assembly and passing from said handle grip assembly down through said bezel assembly, a pair of support tubes, said support tubes having upper ends and lower ends, said support tubes being attached with said support tube upper ends to said bezel assembly from which bezel assembly said support tubes go downward, said support tubes being adapted to receive said sliding tubes therein, locking means accommodated in lower parts of said sliding tubes, attached to said lower ends of said sliding tubes, and adapted to lock said sliding tubes to said support tubes, and control cables connecting said handle grip assembly with said locking means, whereby said locking means can be controlled from said handle grip assembly, wherein said bezel assembly comprises, a bezel base, and said rotating means includes a pair of rollers, said bezel base being provided with two pocket recesses protruding outwardly from lower portions of said side pockets and wherein there is provided a gap between a bottom surface of said rollers and an inner bottom surface of said side pockets to thereby allow pivot said rollers into said pocket recesses at a predetermined angle, said rollers being provided with through holes to receive said sliding tubes, whereby said sliding tubes and said locking means when pulled up can be rotated into a predetermined angle position and locked therein.

7. The retractable handle system as claimed in claim 6, wherein said bezel assembly further comprises hollow sleeves projecting downwardly from a bottom of said bezel base and adapted to receive top portions of said support tubes.

8. The retractable handle system as claimed in claim 6, wherein said rollers are provided with roller pins on both sides of each of said rollers, and each of said side pockets is provided with pocket slots on both sides of said each pocket, said pocket slots being adapted to receive said roller pins.

9. The retractable handle system as claimed in claim 6, wherein said locking means comprises a static element, a movable element, and a locking pin, said static element accommodating a lower end of said sliding tube, said movable element having a spring-loaded fit onto said static element, said locking pin being adapted to move from an unlocked position to a locked position, said movable element operationally controlling said motion of said locking pin.

10. A wheeled luggage with a retractable handle system, said luggage comprising a suitcase-like body with a top, bottom, front, back, and two side sides, said body being equipped with two fixed wheels and at least one caster-like wheel, said fixed wheels and said at least one caster-like wheel being arranged substantially on said bottom side of said body, said retractable handle system being attached to said back side, said retractable handle system comprising:

a handle grip assembly adapted to be acted upon by a user, a bezel assembly, a pair of sliding tubes, said sliding tubes having upper ends and lower ends, the sliding tubes being attached with said upper ends to said handle grip assembly and passing from said handle grip assembly down through said bezel assembly, a pair of support tubes, said support tubes having upper ends and lower ends, said support tubes being attached with said support tube upper ends to said bezel assembly from which bezel assembly said support tubes go downward, said support tubes being adapted to receive said sliding tubes therein, a locking means accommodated in lower parts of said sliding tubes, attached to said lower ends of said sliding tubes, and adapted to lock said sliding tubes to said support tubes, and a support adapted to receive said lower ends of said support tubes and secure same therein, wherein said bezel assembly comprises a bezel base, and rotating means includes a pair of rollers, said bezel base being provided with two identical side pockets to accommodate said rollers, said rollers being provided with through holes adapted to receive said sliding tubes, said bezel base is provided with two pocket recesses protruding outwardly from lower portions of said side pockets and wherein there is provided a gap between a bottom surface of said rollers and an inner bottom surface of said side pockets, to thereby allow pivot of said rollers into said pocket recesses at a predetermined angle, whereby said sliding tubes and said locking means when pulled up can be rotated into a predetermined angle position and locked therein.

11. The wheeled luggage with a retractable handle system as claimed in claim 10, further comprising control cables connecting said handle grip assembly with said locking means, whereby said locking means can be controlled from said handle grip assembly.

12. The wheeled luggage with a retractable handle system as claimed in claim 10, wherein said bezel assembly further comprises hollow sleeves projecting downwardly from a bottom of said bezel base and adapted to receive top portions of said support tubes.

13. The wheeled luggage with a retractable handle system as claimed in claim 10, wherein said locking means comprises a static element, a movable element, and a locking pin, said static element accommodating a lower end of said sliding tube, said movable element having a spring-loaded fit onto said static element, said locking pin being adapted to move from an unlocked position to a locked position, said movable element operationally controlling said motion of said locking pin.

* * * * *